US006383033B1

(12) United States Patent
Politsky et al.

(10) Patent No.: US 6,383,033 B1
(45) Date of Patent: May 7, 2002

(54) SIDE LOAD ELECTRICAL CONNECTOR

(75) Inventors: Peter M Politsky, Warren; David C. Heffner, Williamsfield; Robert S. Lesigonich, Chardone, all of OH (US); Thomas F. Cunningham, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/732,288

(22) Filed: Dec. 7, 2000

(51) Int. Cl.[7] ..... H01R 13/502
(52) U.S. Cl. ..... 439/686; 439/492; 439/493
(58) Field of Search ..... 439/686, 492, 439/493, 494, 495, 496, 497, 498, 499, 67, 77, 599

(56) References Cited

U.S. PATENT DOCUMENTS 4,382,652 A * 5/1983 Sinclair ..... 339/103
4,605,276 A * 8/1986 Hasircoglu ..... 339/176
4,909,753 A * 3/1990 Siemon et al. ..... 439/395
5,888,096 A * 3/1999 Soes et al.

* cited by examiner

*Primary Examiner*—P. Austin Bradley
*Assistant Examiner*—Alexander Gilman
(74) *Attorney, Agent, or Firm*—Thomas A. Twomey

(57) ABSTRACT

A terminal side load electrical connector positions a series of terminals of a flex circuit into a core in unison. The core has a peripheral surface extending between a contact surface and a conductor surface. The terminals are assembled to the core through the peripheral surface. A housing has a conductor opening opposite to a contact opening. The core with the pre-assembled terminals insert into the housing through the conductor opening. The contact surface of the core is exposed through the contact opening of the core. The housing engages the peripheral surface of the core thereby preventing the disengagement of the terminals from the core.

8 Claims, 4 Drawing Sheets

SIDE LOAD ELECTRICAL CONNECTOR

TECHNICAL FIELD OF THE INVENTION

This invention relates to an electrical connector and more particularly to an electrical connector for flex circuits.

BACKGROUND OF THE INVENTION

Electrical connectors commonly provide convenient plugging type terminations for electrical cables including flex circuits. An electrical connector for a flex circuit is elongated and houses a multitude of parallel and evenly spaced terminals pre-crimped to the conductors of the flex circuit. The terminals project longitudinally from and planar to the flex circuit. Because the terminals are actually crimped about the conductors to the substrate material of the flex circuit itself, movement of the terminals relative to each other is very limited and lengthwise movement is restricted altogether. For this reason, and unlike separately insulated wires of a cable, all of the flex circuit terminals must be inserted into a core or female portion of an electrical connector in unison. This means the leading or free end of each terminal is first inserted into individual cavities within the core from a lengthwise direction of the cavity. The cavity is generally perpendicular to the longitude of the connector. Once the leading end of the terminal group is inserted, the remaining portion of every terminal is pushed into the cavity in unison. Unfortunately, aligning the terminal ends to the cavities in unison is difficult and time consuming. Furthermore, pushing all of the terminals into the cavities in unison is prone to damage the flex circuit.

SUMMARY OF THE INVENTION

Accordingly, the present invention is an electrical connector having a core shrouded by a housing when assembled. The core has a peripheral surface extending between a contact surface and a conductor surface. A plurality of cells are spaced along the peripheral surface and extend between the contact surface and the conductor surface. Each cell has an elongated groove exposed longitudinally through the peripheral surface. The ends of the groove are exposed through the contact surface and the conductor surface. The terminals are inserted laterally into the elongated grooves, preferably with a slight press fit.

The housing has a peripheral wall extending between a conductor edge and a contact edge. The conductor edge defines a conductor opening and the contact edge defines a contact opening. After all of the terminals are press fitted into the elongated grooves of the core, the core is inserted through the conductor opening of the housing. When assembled, the contact surface is exposed through the contact opening of the housing. An inner surface of the housing engages the peripheral surface of the core thereby assuring the terminals are held within the elongated grooves.

Preferably each cell of the core has a recess communicating with the groove. Mating with the recess is a tab projecting perpendicularly from the terminal. The tab prevents lengthwise movement of the terminal with respect to the groove of the core. Also preventing lengthwise movement of the terminal with respect to the core are conductor and contact shoulders of the cell. An enlarged contact end of the terminal is disposed between the shoulders within the groove. The shoulders thereby provide lengthwise placement of the terminal with respect to the core.

A feature of the invention is the ability to side load a plurality of terminals crimped to a flex circuit into a core of an electrical connector thereby reducing the amount of time necessary to assemble the electrical connector and limiting the amount of stress placed on the flex circuit during assembly.

These and other objects features and advantages of the invention will become more apparent from the following description of a preferred embodiment taken in conjunction with the accompanying drawings.

BRIEF DESCRIPTION OF THE DRAWINGS

The presently preferred embodiment of the invention is disclosed in the following description and in the accompanying drawings wherein.

DETAILED DESCRIPTION OF THE PREFERRED EMBODIMENT

Figure 1:
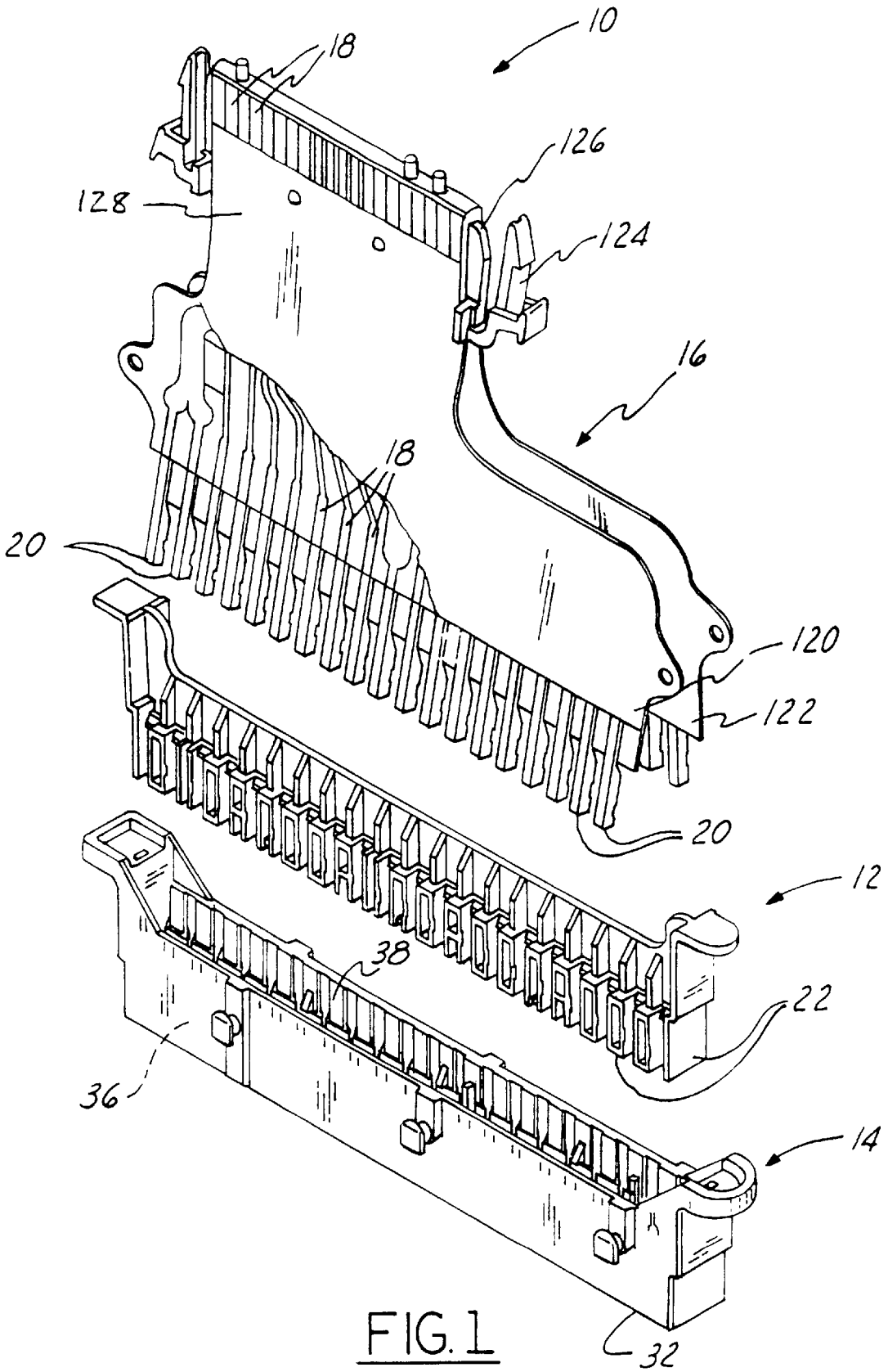
FIG. 1 is an exploded perspective view of an electrical connector of the present invention.

Referring now to the drawings and in particular to FIG. 1, a side load electrical connector 10 comprises an elongated core 12 mounted substantially within a housing 14 when assembled. A plurality of terminals 20 are electrically attached or crimped to respective conductors 18 of a conductor cable 16 of a flex circuit or ribbon cable type. The terminals 20 are crimped to the respective conductors 18 through the substrate of the flex circuit. The terminals 20 are substantially planar to the conductor cable 16 and generally project lengthwise or longitudinally therefrom. Consequently, the terminals 20 are not capable of any significant lengthwise movement with respect to each other or with respect to the conductor cable 16.

The core 12 has a peripheral surface 22 extending between a contact surface 24 and a conductor surface 26. Each crimped terminal 20 press fits into a groove 40 of a cell 28 past the peripheral surface 22. The cells 28 and grooves 40 are substantially perpendicular to the longitude of the core 12 and parallel to one-another. The housing 14 extends between a contact edge 32 and a conductor edge 34. The contact edge 32 defines a contact opening 36 and the conductor edge 34 defines a generally parallel conductor opening 38. The core 12, along with the pre-press fitted terminals 20, insert within the housing 14 through the conductor opening 38. When assembled, the contact surface 24 of the core 12 is exposed through the contact opening 36 of the housing 14. The contact surface 24 is substantially planar to the contact edge 32 of the housing 14. The housing 14 encompasses and engages the peripheral surface 22 of the core 12 and thereby prevents the terminals 20 from moving in an outward direction from the peripheral surface 22.

Figure 3:
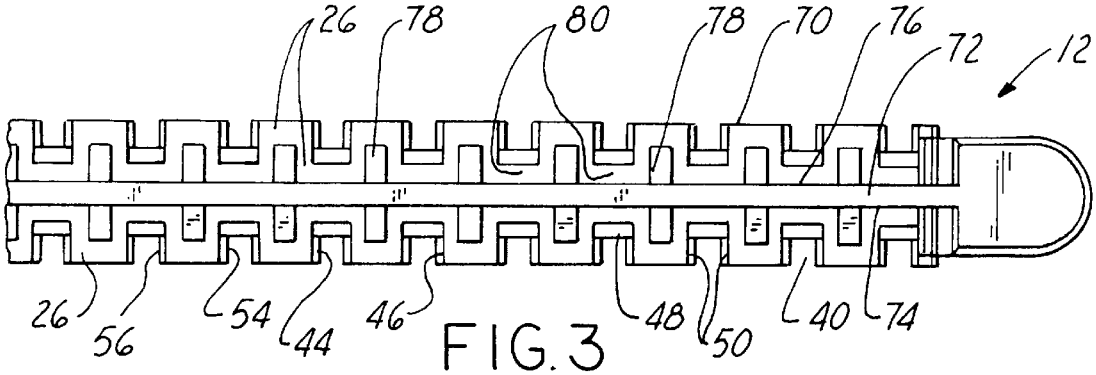
FIG. 3 is a top view of the core.
Figure 2:
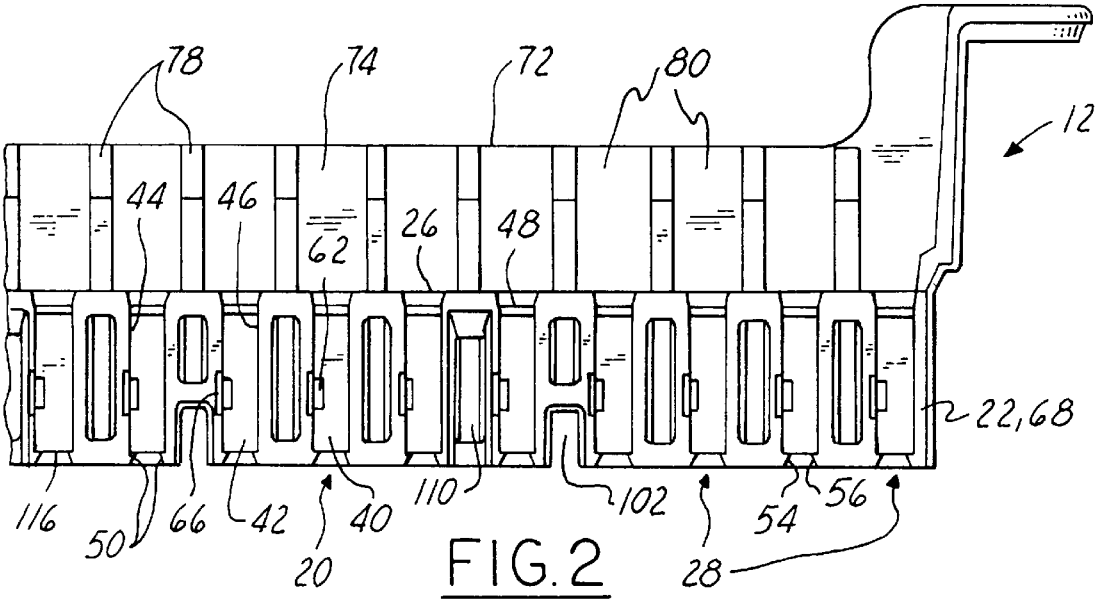
FIG. 2 is a front view of a core of the electrical connector.
Figure 4:
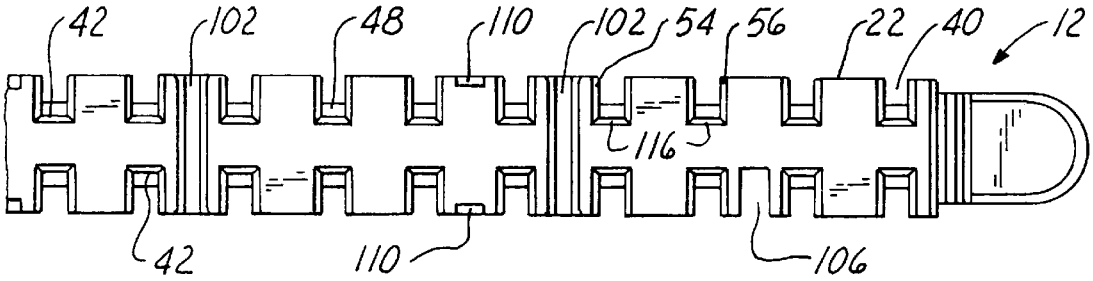
FIG. 4 is a bottom view of the core.

Referring to FIGS. 2–4, the cells 28 of the core 12 extend between the contact surface 24 and the conductor surface 26 of the core 12. The groove 40 of each cell 20 is defined by a back surface 42, a left surface 44 and a right surface 46. The left surface 44 is substantially parallel to the right surface 46 and both the left and right surfaces 44, 46 are substantially perpendicular and extend laterally from the back surface 42 to the peripheral surface 22. The groove 40 therefore communicates longitudinally through the peripheral surface 22, and through the conductor and contact surfaces 26, 24 of the core 12 at either end of the groove 40.

Referring to FIGS. 2–5, a conductor shoulder 48 of the cell 28 protrudes into the groove 40 substantially near the conductor surface 26 of the core 12. And, a contact shoulder 50 protrudes into the groove 40 substantially near the contact surface 24. A radially enlarged contact end 52 of the terminal 20 is disposed between the conductor shoulder 48 and the contact shoulder 50 when press fitted into the groove 40. The contact end 52 of the terminal 20 is preferably of a female type and is exposed through, and substantially perpendicular to, the contact surface 24 of the core 12. The conductor and contact shoulders 48, 50 prevent the terminal 20 from moving in an axial or lengthwise direction during the necessary plugging and unplugging action of the electrical connector 10. Although the contact and conductor shoulders 50, 48 may be situated on either the back, left, or right surfaces 42, 44, 46 of the cell 28, the conductor shoulder 48 preferably attaches to the back surface 42, and the contact shoulder 50 divides into a left member 54 attaching to the left surface 44 and a right member 56 attaching to the right surface 46.

Referring to FIGS. 2–9, the conductor shoulder 48 has a beveled edge 58 forming congruently to the conductor surface 26 and functioning as an injection mold relief. The left and right members 54, 56 of the contact shoulder 50 both have a beveled edge 60 disposed in an outward direction from the groove 40 and diverging congruently to the contact surface 24. The enlarged contact end 52 or female receptor of the terminal 20 and the beveled edges 60 serve to guide the mating electrical pins into the enlarged contact end 52 (not shown).

Formed into the groove 40 is a recess 62 which mates with a protruding tab 64 of the terminal contact end 52 when the electrical connector 10 is assembled. Recess 62 can be formed into the left or right surfaces 44, 46, and recess 62 then communicates with the groove 40 and exposes through the peripheral surface 22. However, because of preferred wall thickness geometry of the core 12, the recess 62 forms into the back surface 42 of the cell 20. Therefore, the recess 62 is disposed axially between the conductor shoulder 48 and the contact shoulder 50, communicating with the groove 40. The tab 64 of the enlarged contact end 52 substantially protrudes perpendicularly from the longitude of the terminal 20. When assembled the tab 64 is disposed within the recess 62. To simplify manufacturing of the terminal 20, the tab 64 is generally planar and adjoins unitarily to a side wall of the terminal 20 and perpendicular to a back wall of the terminal 20. Consequently, either the left or the right side of the recess 62 is planar or flush with the respective left or right surface 44, 46 of the cell 28. As illustrated, the recess 62 is generally planar to the left surface 44. Guiding the tab 64 into the recess 62 is a chamfered surface 66 disposed outward from the recess 62. Chamfered surface 66 congruently forms to the peripheral surface 22 of the core 12 and the left surface 44 of the cell 28. Chamfered surface 66 functions to guide the tab 64 when the terminal 20 is press fitted into the groove 40 of the cell 28 from a side or lateral direction to the core 12.

The cells 28 are preferably disposed on both an elongated front face 68 and an elongated rear face 70 of the peripheral surface 22. The cells 28 on the front face 68 are disposed back-to-back to the cells 28 on the rear face 70. This symmetry prevents communication between recesses 62 and therefore prevents contact between terminal tabs 64 which must be electrically insulated from one-another. Also providing electrical insulation between terminals 20 is an insulating wall 72 generally protruding laterally outward from the longitudinal center of the conductor surface 26. The wall 72 also provides lateral support for the conductor cable or flex circuit 16. The insulating wall 72 has a front side 74 and a back side 76 both having a plurality of ribs 78 defining a plurality of channels 80 extending substantially perpendicular to the longitude of the insulating wall 72. Each channel 80 is substantially co-linear to each respective groove 40 of the cell 28. Situated within each channel 80 and electrically insulated from each other by the insulating wall 72 is a gripping end 82 of the terminal 20. Each gripping end 82 electrically engages a conductor 18 preferably by crimping the conductor 18 through the substrate of the flex circuit.

Figure 5:
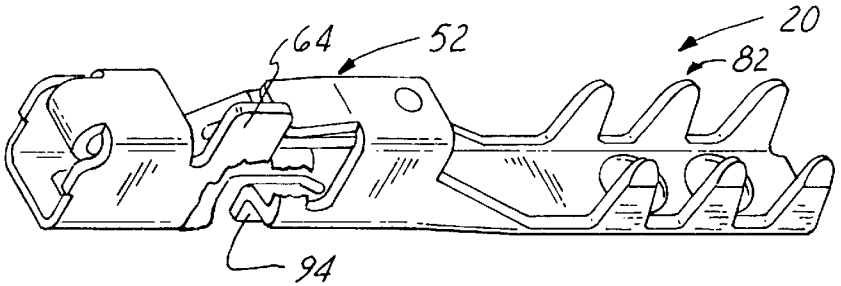
FIG. 5 is a perspective view of a terminal before being crimped to a flex circuit.
Figure 6:
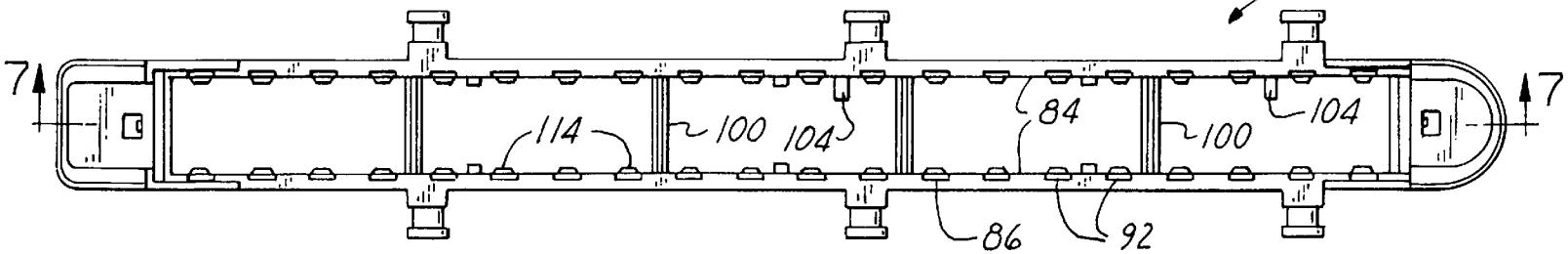
FIG. 6 is a top view of a housing of the electrical connector.
Figure 7:
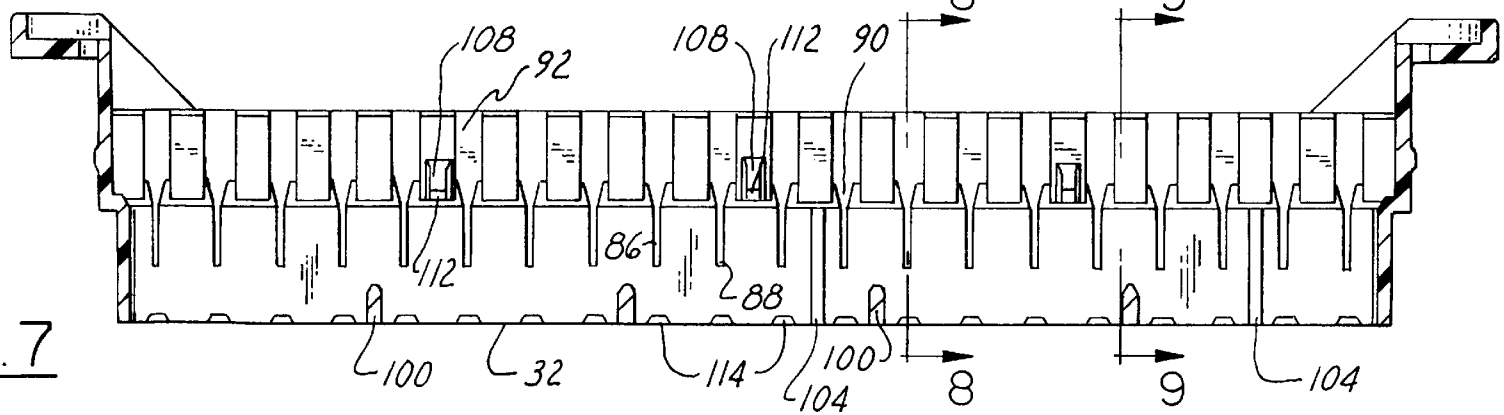
FIG. 7 is a cross sectional view of the housing taken along the line 7—7 of FIG. 6 viewed in the direction of the arrows.
Figure 9:
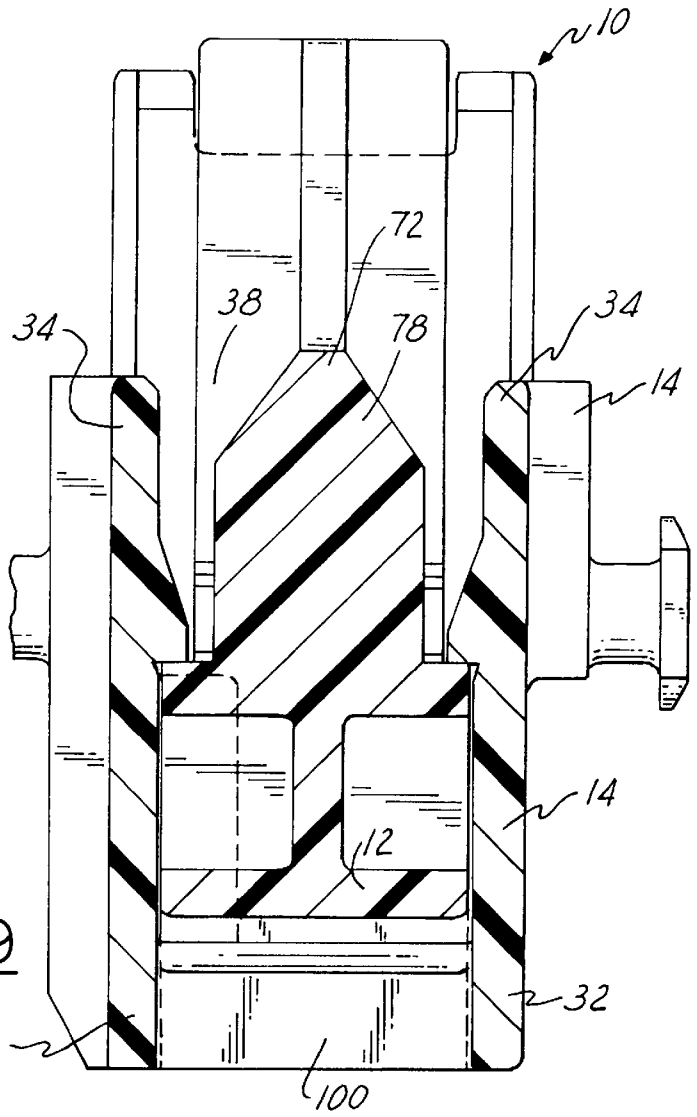
FIG. 9 is a cross sectional view of the electrical connector taken along the line 9—9 of FIG. 7 viewed in the direction of the arrows.
Figure 8:
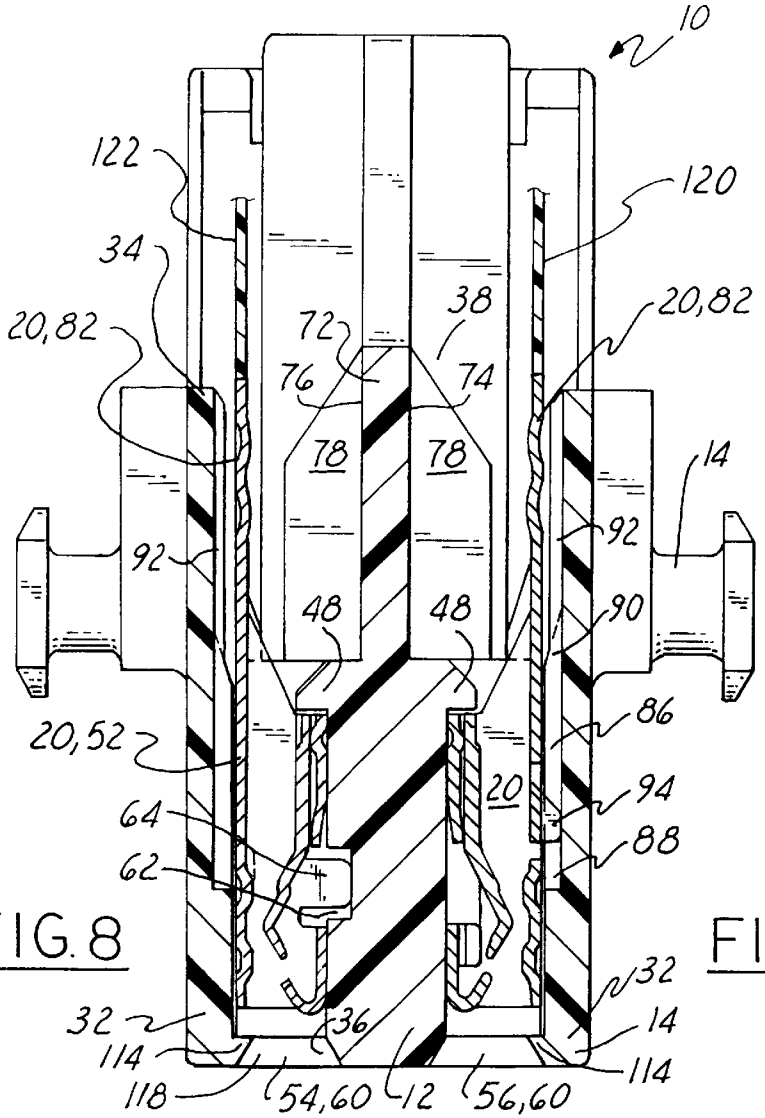
FIG. 8 is a cross sectional view of the electrical connector taken along the line 8—8 of FIG. 7 viewed in the direction of the arrows.

Referring to FIGS. 5–7, the housing 14 has an inner surface 84 opposing the peripheral surface 22 and the front and back sides 74, 76 of the insulating wall 72 of the core 12. In assembly, the housing 14 completely shrouds the core 12 and therefore the contact end 52 and the gripping end 82 of the terminal 20. When the side load connector 10 is assembled, a crevice 86 defined by the inner surface 84 aligns and opposes the groove 40 of each cell 28. The crevice 86 extends between a stop end 88 and a mouth end 90; the crevice 86 falls short of the contact edge 32 of the housing 14 and the mouth end 90 which communicates with a clearance 92. The clearance 92 is also defined by the inner surface 84 and aligns to the channel 80 of the core 12. The clearance 92 is wider than the crevice 86 and helps to guide a nubble 94 rigidly protruding from the contact end 52 of the terminal 20 into the crevice 86. Preferably, the nubble 94 protrudes outward from a side of the contact end 52 opposite from the side having the tab 64. In assembly, the nubble 94 is disposed within the crevice 86 at the stop end 88 and the gripping end 82 of the terminal 20 is disposed between the clearance 92 of the housing 14 and the channel 80 of the core 12.

The inner surface 84 of housing 14 has a longitudinal first side 96 and an opposing longitudinal second side 98. Spanning between the first and second sides 96, 98 of the housing 14 near the contact edge 32 of the housing 14 is at least one bridge 100. Bridge 100 provides rigidity between the first and second sides 96, 98 and provides an indexing placement for the core 12 relative to the housing 14. The bridge 100 mates with a slot 102 disposed between the cells 28 and communicating longitudinally through the contact surface 24 of the core 12. The contact surface 24 of the core 12 is thereby substantially flush with the contact edge 32 of the housing 14 when assembled.

To assure that core 12 and housing 14 are properly assembled, it is necessary that the front side 74 of insulating wall 72 opposes the first side 96 of the inner surface 84 of the housing 14, and at least one elongated protrusion 104 extends from either the first side 96 or the second side 98 of the housing inner surface 84. Mating with the protrusion 90 is a slit 106 disposed longitudinally through the peripheral surface 22 of the core 12. The slits 106 are generally parallel to and extend the length of the cells 28.

To snap lock the core 12 to the housing 14, a plurality of burs protrude from the inner surface 84 of the housing 14. The burs 108 are beveled at the upward or trailing side toward the conductor edge 34 so that voids 110 disposed between selected cells 28 receive the burs 108 in a snap fitted arrangement. The burs 108 have an engagement end 112 which is substantially perpendicular to the inner surface 84. The engagement end 112 engages the conductor surface 26 when the core 12 is locked within the housing 14 thereby preventing the core 12 from lifting away from the bridge 100 and out of the housing 14.

Molded substantially flush to the contact edge 32 of the housing 14 and projecting inward from the inner surface 84 are a series of beveled tangs 114. Each tang 114 is aligned to a cell 28 of a core 12. The tang 114 extends between the left and right members 54, 56 of the contact shoulder 50. The contact surface 24 has a plurality of beveled surfaces 116. Each beveled surface 116 is congruent to and spans the width of the back surface 42 of each cell 28. The beveled tang 114, the beveled left and right members 54, 56, and the beveled surface 116 form a four-sided beveled edge aperture 118 for easy receipt of a contact pin into the enlarged female contact end 52 of the terminal 20 through the contact surface 24 of the core 12.

Referring to FIG. 1, the conductor cable 16 or flex circuit has a first end 120 and a second end 122. Each end 120, 122 has a series of terminals 20 and conductors 18. The terminals 20 of the first end 120 are disposed adjacent to the front face 68 and front side 74 of the core 12. And, the terminals 20 of the second end 122 are disposed adjacent to the rear face 70 and back side 76 of the core 12. A mid-portion 128 of the conductor cable 16 loops about a plug member 124 having a leading edge 126. The conductors 18 are exposed outwardly about the leading edge 126 to achieve electrical contact with external devices.

While the forms of the invention herein disclose constitute presently preferred embodiments many others are possible it is not intended herein to mention all of the possible equivalent forms or ramifications of the invention; it is understood that the terms used here are merely descriptive rather than limiting and at various changes may be made without departing from the spirit or scope of the invention.

We claim:

1. An electrical connector comprising:

a core having a peripheral surface, a contact surface, a conductor surface, and at least one cell, the peripheral surface extended between the conductor surface and the contact surface, the at least one cell extended from the contact surface. through the conductor surface, the cell having a groove and a recess, the groove exposed through the contact and conductor surfaces, and exposed longitudinally through the peripheral surface of the core, the recess communicating transversely with the groove;

a terminal disposed longitudinally in the groove of the cell and exposed through the contact surface of the core, the terminal being inserted laterally into the groove past the peripheral surface, the terminal having a tab projecting perpendicularly from the terminal, the tab disposed within the recess of each one of the plurality of cells; and a housing having a peripheral conductor edge, a peripheral contact edge and an inner surface, the inner surface extended between the conductor and contact edges, the peripheral surface of the core engaged by the inner surface of the housing to retain the terminal in the at least one cell laterally, the contact surface of the core exposed through the housing inward of the contact edge of the housing.

2. The electrical connector as set forth in claim 1 wherein each one of the plurality of cells have a conductor shoulder and a contact shoulder extending transversely and protruding into the groove, and wherein the terminal has a contact end exposed through the contact surface of the core and disposed between the conductor and contact shoulders of each one of the plurality of cells.

3. An electrical connector comprising:

a core having a peripheral surface, a contact surface, a conductor surface, and a plurality of cells, the peripheral surface extended between the conductor surface and the contact surface, the plurality of cells extended from the contact surface through the conductor surface, the plurality of cells each having a groove exposed through the contact and conductor surfaces, the groove exposed longitudinally through the peripheral surface of the core;

a conductor cable selected from the group consisting of a flex circuit and a ribbon cable, the conductor cable having a plurality of conductors each one engaged electrically to a terminal disposed longitudinally in the groove of the respective plurality of cells and exposed through the contact surface of the core, the terminal being inserted laterally into the respective groove past the peripheral surface; and a housing having a peripheral conductor edge, a peripheral contact edge and an inner surface, the inner surface extended between the conductor and contact edges, the peripheral surface of the core engaged by the inner surface of the housing to retain laterally the terminal in each one of the plurality of cells, the contact surface of the core exposed through the housing inward of the contact edge of the housing.

4. The electrical connector as set forth in claim 3 wherein a nubble projects from the terminal, the nubble slidably engaging a crevice defined by the inner surface of the housing when the core is inserted within the housing, the nubble disposed at the stop end of the crevice when the core is fully inserted into the housing.

5. An electrical connector comprising:

a core having an elongated front face, an elongated rear face, a contact surface, a conductor surface, and a plurality of cells, the front face parallel to the rear face, the front and rear faces each extended laterally between the conductor surface and the contact surface, the plurality of cells divided between the front and rear faces, the plurality of cells disposed tranversely and spaced evenly along the front and rear faces and each extended from the contact surface through the conductor surface, the plurality of cells each having a groove exposed through the contact and conductor surfaces, the groove exposed longitudinally through the peripheral surface of the core;

a flex circuit having a plurality of conductors and a mid portion, the plurality of conductors having a first end and a second end, the first and second ends each engaged to a terminal disposed longitudinally in the groove of the respective plurality of cells and exposed through the contact surface of the core, the terminals engaged to the first ends of the plurality of conductors being inserted laterally into the respective groove past the front face of the core, the terminals engaged to the second ends of the plurality of conductors being inserted laterally into the respective groove past the rear face of the core; and a housing having a peripheral conductor edge, a peripheral contact edge and an inner surface, the inner surface extended between the conductor and contact edges, the front and rear faces of the core engaged by the inner surface of the housing to retain laterally the plurality of terminals in the plurality of cells, the contact surface of the core exposed through the housing inward of the contact edge of the housing.

6. The electrical connector as set forth in claim 5 further comprising a plug member having a leading edge, the flex circuit folded over the leading edge at the mid portion, the plurality of conductors exposed outwardly over the leading edge of the plug.

7. The electrical connector as set forth in claim 5 further comprising:

a wall extended outwardly from the conductor surface of the core, the wall having a front side and a back side;

a plurality of ribs extended laterally outward from the front and back sides of the wall, the plurality of ribs extended longitudinally outward from the conductor surface between each groove; and a plurality of channels defined by the plurality of ribs and the respective front and back sides of the wall, the terminal disposed within each one of the plurality of channels.

8. The electrical connector as set forth in claim 6 further comprising:

a wall extended outwardly from the conductor surface of the core, the wall having a front side and a back side;

a plurality of ribs extended laterally outward from the front and back sides of the wall, the plurality of ribs extended longitudinally outward from the conductor surface between each groove; and a plurality of channels defined by the plurality of ribs and the respective front and back sides of the wall, the terminal disposed within each one of the plurality of channels.

* * * * *